United States Patent [19]

Guerrini

[11] 4,036,348

[45] July 19, 1977

[54] FIXING DEVICE FOR A TYPE-CARRIER DISK

[75] Inventor: Giampaolo Guerrini, Ivrea (Turin), Italy

[73] Assignee: Ing. C. Olivetti & C., S.p.A. Ufficio Brevetti, Ivrea (Turin), Italy

[21] Appl. No.: 594,067

[22] Filed: July 8, 1975

[30] Foreign Application Priority Data

July 10, 1974 Italy ..... 69194/74

[51] Int. Cl.[2] ..... B41J 1/30

[52] U.S. Cl. ..... 197/53; 197/18

[58] Field of Search ..... 197/6.7, 18, 52–55; 403/201, 261, 263, 325, 327, 330

[56] References Cited

U.S. PATENT DOCUMENTS

| | | | |
|---|---|---|---|
| 2,127,509 | 8/1938 | Fuchs | 197/53 X |
| 3,432,018 | 3/1969 | Watanabe et al. | 197/55 X |
| 3,608,935 | 9/1971 | Hodapp, Jr. | 403/325 X |
| 3,878,929 | 4/1975 | Orlens et al. | 197/18 X |

OTHER PUBLICATIONS

IBM Tech. Discl. Bulletin, R. D. Mathews, vol. 13, No. 1, June 1970, p. 214.

*Primary Examiner*—Edgar S. Burr
*Assistant Examiner*—Paul T. Sewell
*Attorney, Agent, or Firm*—Schuyler, Birch, Swindler, McKie & Beckett

[57] ABSTRACT

A fixing device for a type-carrier disk in which the selection shaft includes a selection shaft, a flange defining a rotation plane and a conical end. The type-carrier disk comprises a central part cooperating with the flange and a conical seat for housing the conical end of the shaft. The central part of the disk has two apertures disposed symmetrically with respect to the conical seat for housing fixing members pivotally mounted on the flange. Resilient elements cooperate with the fixing members for holding the central part of the disk tight against the flange and the conical seat tight against the conical end of the shaft. A knob of the central part is adapted to remove the disk from the selection shaft against the action of the resilient elements.

14 Claims, 3 Drawing Figures

FIXING DEVICE FOR A TYPE-CARRIER DISK

BACKGROUND OF THE INVENTION

The present invention relates to a fixing device for a type carrier disk with flexible tongues mounted onto the selection shaft of a printing office machine, where the selection shaft includes contrast means which define a rotation plane of the said disk and where the type-carrier disk comprises a central part for cooperating with the contrast means of the selection shaft.

Fixing devices like that mentioned above are well-known in the art. The type-carrier disk is normally supported by a selection shaft through a fixed connection such as screws or using elastic loops. This system has several drawbacks: either the interchanging of the type-carrier disk is a lengthy and complex procedure or the alignment of the flexible tongues during the rotation of the type-carrier disk is imperfect and leads to lack of precision in typing.

SUMMARY OF THE INVENTION

The present invention relates to a fixing device for a type-carrier disk with flexible tongues which enables the rapid mounting and detaching of the type-carrier disk with a more efficient tongue alignment, the secure fixing of the type-carrier disk onto the selection shaft, and which at the same time is simple to use and cheap to produce.

According to the invention there are provided fixing elements which are symmetrical with the selection shaft, and positioned using resilient means as regards the above-mentioned contrast means. The central part of the said disk is equipped with apertures appropriate for the housing of the said fixing elements so that they hold the above-mentioned central part tight against the said contrast element. A knob is provided, in this central part, for the removal of the said selection shaft, against the action of the said resilient means.

A preferred embodiment of the invention will be described in more detail, by way of example, with reference to the accompanying drawings.

Figure 1:
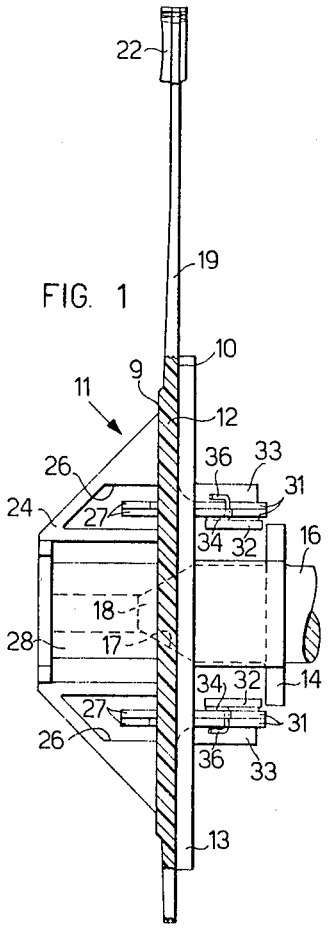
FIG. 1 is a partial longitudinal view of the fixing device according to the invention.
Figure 2:
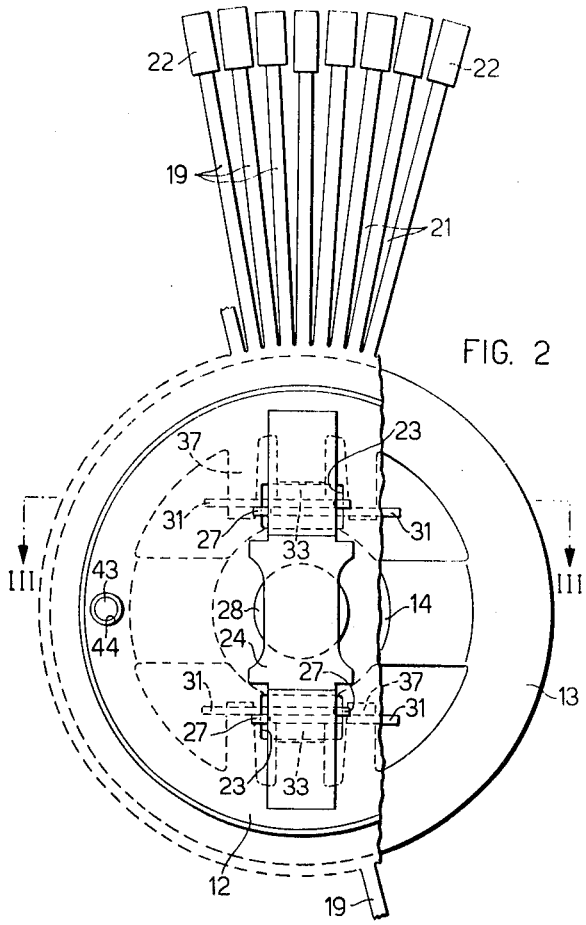
FIG. 2 is a partial frontal view of the device of FIG. 1.

DETAILED DESCRIPTION OF THE INVENTION:

As regards FIG. 1 the fixing device according to the invention comprises a type-carrier disk generally indicated by the number 11 made out of plastic material, for example nylon with fibre glass, with a central part 12 consisting of a piece with a peripheral notched crown from which derive flexible tongues 19 (FIG. 2) separated one from the other by radial spaces 21 and bearing at one end a corresponding type character 22.

The central part 12 has a substantially flat surface 10 (FIG. 1) engageable with contrast means 13 constituted by the peripheral crown of a flange 14. The flange 14 is fixed to a selection shaft 16 of a printing office machine not shown in the drawings on which the disk 11 can be fixed in the way here described in order to rotate parallel to the rotation plane defined by the crown 13 and thus select the characters 22 in front of the corresponding printing point of the machine in a manner known per se.

The central part 12 of the disk 11 includes a conical seat 17, which can be engaged by a conical end 18 from the selection shaft 16 and two apertures 23 (FIG. 2), rectangular in form disposed diametrically opposite each other in relation to the conical seat 17 (FIG. 1).

A knob 24 protrudes from surface 9 of the central part 12 opposite surface 10. This knob 24 is substantially trapezoidal in outline and can be gripped when assembling or detaching the type-carrier 11 from the selection shaft 16. The knob 24 has two slots 26 which correspond to the apertures 23 (FIG. 2) and a cylindrical central part 28 which is hollow and coaxial with the conical seat 17 (FIG. 1).

Figure 3:
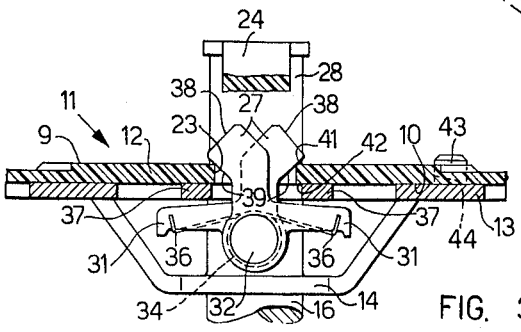
FIG. 3 is partial section according to line III—III of FIG. 2.

The slots 26 and the apertures 23 (FIG. 2) are able to house fixing elements or members which consist of four teeth 27 (FIG. 1) each equipped with a lug 31 (FIG. 3) perpendicular to the tooth itself 27. The teeth 27 are fulcrumed in pairs, but rotated 180° between them on their respective pivots 32 fixed on two tongues 33 (FIG. 1) of the crown 13 of the flange 14. Spring means comprising a spring 34 is mounted on each pivot 32 with two arms 36 (FIG. 3) which bear elastically against the respective lug 31 of the fixing element 27.

When the type-carrier disk 11 is not mounted, each spring 34 holds the two elements 27 one rotating in a clockwise direction and the other in a counter-clockwise direction with the lugs 31 held against two corresponding stops 37 of the crown 13.

Each tooth 27 is formed of contiguous edges 38 and 39 substantially perpendicular to each other and able to collaborate with upper contrast edges 41 and lower contrast edges 42 of the apertures 23 of the central part 12 during the mounting and detaching of the type-carrier disk 11.

Moreover a pin 43 is incorporated into the crown 13 to fit a hole 44 (FIG. 2) in the central part 12 in order to define exactly the angular position of the type-carrier disk 11 (FIG. 1) as regards the selection shaft 16.

The procedure for fixing the type-carrier disk 11 to the selection shaft 16, is the following.

Using knob 24, the operator aligns the type-carrier disk 11 with respect to the shaft with the seat 17 coaxial with the conical end 18 of the selection shaft 16 and with the pin 43 (FIG. 3) aligned with the hole 44 of the central part 12. Thus the lower edges 42 of the apertures 23 correspond with the edges 38 of the teeth 27. A manual pressure is now applied perpendicular to the flange 14, this pressure being greater than the tensions of the springs 34.

The lower edges 42 of the apertures 23 sliding on the edges 38 of the teeth 27 cause two of them to rotate in a clockwise direction and the other two in a counter-clockwise direction against the actions of the springs 34. Continuing to exert manual pressure, the conical end 18 (FIG. 1) completely engages the seat 17 while the surface 10 of the central part 12 is held tight against the crown 13. Since the teeth 27, across apertures 23 (FIG. 3), have now passed the surface 9 of part 12 with edges 38, they are quickly released by the two springs 34, two in a clockwise direction and two in a counter-clockwise direction until a first position in which the edges 39 engage the upper edges 41 of the apertures 23, thus blocking the type-carried disk 11 on the selection shaft 16.

The pressure exerted by the edges 39 of the teeth 27 on the upper edges 41 of the apertures 23, through the tensions of the springs 34, cause the conical seat 17 (FIG. 1) to adhere to the end 18 of the selection shaft 16 and the surface 10 of the central part 12 to the crown 13 of the flange 14. The fixing pressure is exerted in an intermediate zone between the conical and flat couplings, so as to compensate for any play between the two parts.

The procedure for the detaching of the type-carrier disk 11 from the selection shaft 16, is as follows.

Gripping the handle with one hand the knob 24 and pulling outwards, perpendicularly to the flange 14, the upper edges 41 (FIG. 3) of the apertures 23, slide on the edges 39 of the teeth 27. Two teeth 27 rotate then in a clockwise direction and two teeth 27 rotate in a counter-clockwise direction against the actions of the springs 34. As soon as the teeth 27 have reached a second position thereof in which the teeth 27 have passed the corresponding aperture 23 with the edges 39, the type-carrier disk 11 is free while the two springs 34 cause the teeth 27 to be quickly released until they are halted by their lugs 31 against the fixed stops 37.

What I claim is:

1. A fixing device for attaching a type-carrier disk with flexible tongues to a selection shaft of a printing machine, wherein said selection shaft has a shaft axis and includes contrast means defining a rotation plane substantially perpendicular to said shaft axis and a conical end, said contrast means extending radially outwardly a predetermined radial distance from said shaft axis, and wherein said type-carrier disk comprises a central part and a conical seat for cooperating, respectively, with said contrast means and said conical end for aligning said type-carrier disk with respect to said selection shaft, and means for exactly defining the angular position of said disk with respect to said selection shaft, said fixing device comprising:

at least one aperture in said disk, said aperture being defined in part by a first aperture edge radially spaced from said shaft axis a distance less than said predetermined radial distance, at least one attachment member supported by said selection shaft and extending axially beyond said rotation plane and at an angle thereto, said attachment members being extendable through said apertures, each of said attachment members being movable between a first position wherein said attachment member can be passed through said aperture and a second position wherein said attachment member engages said first edge of said aperture, resilient means urging said attachment members toward said second position so that when said attachment means extends into said aperture said attachment means engages said first edge to hold said type-carrier disk against said contrast member and said conical seat against said conical end, and knob means for attaching and detaching said type-carrier disk.

2. A fixing device as in claim 1, wherein said knob means protrudes from said type-carrier disk and comprises a central cylindrical hollow portion coaxial with said conical seat.

3. A fixing device as in claim 1, wherein each said attachment member comprises a tooth lying in a plane substantially perpendicular to said rotation plane, each said tooth comprising first and second substantially contiguous tooth edges oriented toward said first aperture edge and converging toward one another and joined to one another at a corner, said first tooth edge being engageable with said first aperture edge during insertion of said attachment member into said aperture and said second tooth edge being engageable when said attachment member is cammed by said first aperture edge from said second position to said first position during insertion into said aperture, and is then held in said second position with said second tooth edge in engagement with said first aperture edge.

4. A fixing device as in claim 3 wherein said first and second tooth edges are disposed substantially perpendicularly to one another and at an angle of 45° to said rotation plane.

5. A fixing device as in claim 1, wherein said type-carrier disk comprises a pair of apertures aligned with one another on opposite sides of said shaft axis and each having a first aperture edge, and further comprising at least one attachment member engageable with each of said first aperture edges.

6. A fixing device according to claim 5, wherein each said aperture comprises a second aperture edge in opposed relationship to said first aperture edge, and further comprising attachment members engageable with said second aperture edges.

7. A fixing device as in claim 5, comprising a pair of attachment members mounted on a common pivot, and wherein each of said attachment members comprises a lug, said resilient means comprising a spring having two spring arms coaxial with said common pivot and engaging, respectively, the pair of said lugs.

8. A printing device as in claim 7 in which said knob means has a central part which is cylindrical and hollow inside and co-axial with said conical seat.

9. A printing device as in claim 7 wherein said attachment members include levers fulcrumed on pivots of said contrast means and lying on planes parallel to said rotation plane.

10. A printing device according to claim 7 wherein each of said attachment elements comprises a tooth, and said attachment edge comprises a pair of tooth edges disposed substantially perpendicularly to one another and at an angle of substantially 45° to said rotation plane, said first tooth edge being engageable with said aperture edge during insertion of said attachment element into said aperture and said second tooth edge being engageable with said aperture edge at least when said attachment means is fully inserted into said aperture, whereby said attachment element operates by a snap action to hold said type-carrier disk against said contrast element.

11. A fixing device as in claim 1, wherein said means for defining the angular position comprises a pin on said contrast means and an opening on said type-carrier disk.

12. A printing device as in claim 11, wherein each said aperture has first and second aperture edges, and each said attachment element comprises first and second of said teeth engageable, respectively, with said first and second aperture edges, each pair of said first and second teeth being pivotally mounted by pivots oriented parallel to said rotation plane.

13. A fixing device for attaching a type-carrier disk with flexible tongues to a selection shaft of a printing machine, wherein said selection shaft has a shaft axis and includes contrast means defining a rotation plane substantially perpendicular to said shaft axis and a conical end, said contrast means extending radially outwardly a predetermined radial distance from said shaft axis, and wherein said type-carrier disk comprises a central part and a conical seat for cooperating, respectively, with said contrast means and said conical end for aligning said type-carrier disk with respect to said selection shaft, and means for exactly defining the angular position of said disk with respect to said selection shaft, said fixing device comprising:

at least one aperture in said disk, said aperture being defined in part by a first aperture edge radially spaced from said shaft axis a distance less than said predetermined radial distance, at least one attachment member supported by said selection shaft and extending axially beyond said rotation plane and at an angle thereto, said attachment members being extendable through said apertures, each of said attachment members being movable between a first position wherein said attachment member can be passed through said aperture and a second position wherein said attachment member engages said first edge of said aperture, resilient means urging said attachment members toward said second position so that when said attachment means extends into said aperture said attachment means engages said first edge to hold said type-carrier disk against said contrast member and said conical seat against said conical end, knob means for attaching and detaching said type-carrier disk, and further comprising pivot means on said contrast means for pivotally supporting said attachment members for movement between said first and second positions, and stop means on said contrast means for limiting movement of said attachment members by said resilient means.

14. In a printing device comprising a rotatable selection shaft and a type-carrier disk with flexible tongues, a contrast element supported by said selection shaft and defining a rotation plane perpendicular to said selection shaft, said type-carrier disk being provided with a central portion having a first plane surface and a second plane surface substantially parallel to said first surface, said second surface cooperating with said contrast element to align said tongues in a plane parallel to said rotation plane, fixing means for attaching said type-carrier disk to said selection shaft comprising:

a plurality of attachment elements symmetrically disposed about said selection shaft and movably supported thereon, a plurality of apertures on said type-carrier disk for receiving said attachment elements, each of said apertures having first and second aperture edges on said first and on second surfaces, respectively, engageable by one of said attachment elements and each of said attachment elements having an attachment edge slidably engageable with said first aperture edge, each said attachment element being movable among a first position wherein said attachment element can pass through said aperture, a second position wherein said attachment edge is in a sliding engagement with said first edge, and a rest position, said second position being located between said first and said rest positions, said attachment elements being biased toward said rest position, each said attachment element having an inclined edge adjacent said attachment edge and slidably engageable with said second aperture edge during attachment to cam said attachment element from said rest position to said first position to permit insertion into said aperture, said type-carrier disk being axially movable with respect to said selection shaft, and said attachment elements and said aperture being movable relative to one another along paths parallel to said selection shaft, and knob means attached to said first plane surface of said type-carrier disk to facilitate attachment and removal of said disk by pushing or pulling axially of said selection shaft to cause camming of the inclined edge of said attachment elements with respect to said second aperture edge for the engagement of said attachment edges with respect to said first aperture edges or, respectively for the sliding of said attachment edges with respect to said first aperture edges for the moving of said attachment elements toward said first position for the removing of the disk.

* * * * *

UNITED STATES PATENT OFFICE
CERTIFICATE OF CORRECTION

Patent No. 4,036,348 Dated July 19, 1977

Inventor(s) Giampaolo Guerrini

It is certified that error appears in the above-identified patent and that said Letters Patent are hereby corrected as shown below:

Page 1, Assignee, change "Assignee: Ing. C. Olivetti & C., S.p.A. Ufficio Brevetti, Ivrea (Turin), Italy to --Assignee: Ing. C. Olivetti & C., S.p.A., of Ivrea(Turin), Italy--

Signed and Sealed this

Second Day of May 1978

[SEAL]

*Attest:*

RUTH C. MASON
*Attesting Officer*

LUTRELLE F. PARKER
*Acting Commissioner of Patents and Trademarks*